US011415326B2

(12) United States Patent
Engelman et al.

(10) Patent No.: US 11,415,326 B2
(45) Date of Patent: Aug. 16, 2022

(54) HEATED WATER SUPPLY SYSTEM AND METHODS THERETO

(71) Applicant: Rheem Manufacturing Company, Atlanta, GA (US)

(72) Inventors: Davis Engelman, Los Gatos, CA (US); Maia Gatlin, Atlanta, GA (US); Carrie Li, Bedford, MA (US); Erik Marquez, Aurora, CO (US); Nishan Guna Sakaran, Kuala Lumpur (MY); Victor Pria, Lawrenceville, GA (US); Mukund Bhaskar, Montgomery, AL (US); Atilhan Manay, Roswell, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/064,055

(22) Filed: Oct. 6, 2020

(65) Prior Publication Data

US 2022/0107094 A1 Apr. 7, 2022

(51) Int. Cl.
*F24D 17/00* (2022.01)
*F24D 19/10* (2006.01)

(52) U.S. Cl.
CPC ..... *F24D 17/0089* (2013.01); *F24D 19/1051* (2013.01)

(58) Field of Classification Search
CPC .. F27D 17/0089; F27D 17/0094; F24D 3/082; F24D 19/1051; F24H 2250/06
See application file for complete search history.

(56) References Cited

U.S. PATENT DOCUMENTS 4,977,885 A 12/1990 Herweyer et al.
8,404,962 B2 3/2013 Birkeland et al.
(Continued)

FOREIGN PATENT DOCUMENTS

CN 104990280 A * 10/2015
DE 102011014527 A1 * 9/2012 ..... F24D 19/1051
(Continued)

OTHER PUBLICATIONS

Yasuki Kadohiro, Shuo Cheng and Jeffrey S. Cross, "All-Day Energy Harvesting Power System Utilizing a Thermoelectric Generator with Water-Based Heat Storage", MDPI, pp. 1-5 (Year: 2020).*

(Continued)

*Primary Examiner* — Edelmira Bosques
*Assistant Examiner* — Michael James Giordano
(74) *Attorney, Agent, or Firm* — Eversheds Sutherland (US) LLP

(57) ABSTRACT

A heated water device is disclosed. The heated water device includes a cold water tank configured to receive cold water from a cold water source and a hot water tank configured to receive water from a hot water source and discharge water to the cold water source. The heated water device includes a pump configured to selectively pump water from the hot water source and to the hot water tank and a valve configured to selectively permit water to flow from the hot water tank to the cold water source. The heated water device includes a thermoelectric generator configured to generate electrical energy from a water temperature differential between cold water in the cold water tank and heated water in the hot water tank.

19 Claims, 8 Drawing Sheets

(56) References Cited

U.S. PATENT DOCUMENTS

| | | | | |
|---|---|---|---|---|
| 2008/0092550 | A1* | 4/2008 | Folsom | F24D 17/0005 60/783 |
| 2008/0136364 | A1 | 6/2008 | Calvarese | |
| 2010/0230071 | A1 | 9/2010 | Slater | |
| 2014/0230869 | A1 | 8/2014 | Chen et al. | |

FOREIGN PATENT DOCUMENTS

| | | | | |
|---|---|---|---|---|
| FR | 3017399 | A1 * | 8/2015 | E03B 1/048 |
| KR | 20150106050 | A * | 9/2015 | |
| WO | WO-2010103521 | A2 * | 9/2010 | F24D 17/0094 |

OTHER PUBLICATIONS

Auckland et al., "Design of a semiconductor thermoelectric generator for remote subsea wellheads," IEE Proceedings—Electric Power Applications 142.2, Mar. 1, 1995, pp. 65-70.

Ahiska et al., "Design and implementation of a new portable thermoelectric generator for low geothermal temperatures," IET Renewable Power Generation 7.6, Nov. 1, 2013, pp. 700-706.

Wu et al., "Heat and Electric Flux Coupling of Closed-Loop Thermoelectric Generator," Energy Conversion and Management 244, Sep. 15, 2021.

International Search Report and Written Opinion for PCT Application No. PCT/US2021/053726 dted Feb. 22, 2022.

* cited by examiner

HEATED WATER SUPPLY SYSTEM AND METHODS THERETO

BACKGROUND

In existing water heating systems, there can be a delay between the time at which a user requests heated water (e.g., by turning on a hot water faucet) and the time at which heated water is outputted at the requested location. This delay can be caused by standby losses experienced by the water heating system. Typically, water heating systems are configured to heat water at a central water heating device and output heated water into a system of pipes connected to the central water heating device. That is, any water that has already been heated is typically retained within the central water heating device unless and until a demand for heated water is detected, at which time heated water is then outputted into the systems of pipes, ultimately reaching the point of use. Between draws, however, the previously heated water that is now resting within the system of pipes can lose heat and become cool. Once the water within the pipes becomes cool, a user must wait for the cooled water to drain until newly heated water reaches the point of use. This delay can be undesirable as the user must wait for newly heated water to reach the point of use, and the flushing of cooled water from pipes often results in wasted potable water.

In attempts to address this issue, electric point-of-use reheating systems have been developed. Existing systems, however, can carry several limitations. For example, such systems are typically difficult to install. Gas-fired systems require a fuel line to be installed at the point of use and also require a vent for exhaust gases from the combustion for heating the water, and electric systems typically require 240V, which at least in the United States, usually requires an electrician to route a 240V line to the point of use. Even if the electric system is configured to operate using 120 electricity, it is likely that an electrician will be needed to run a new electricity line to the point of use (e.g., under a sink). Thus, existing systems can be difficult to install, requiring a specially trained and/or licensed technician, which can be inconvenient and expensive for a user.

SUMMARY

These and other problems are addressed by the technologies described herein. Examples of the present disclosure relate generally to methods and devices for providing a substantially immediately available supply of hot water at a point-of-use (POU) plumbing fixture (e.g., a sink, a shower).

The disclosed technology includes a point-of-use (POU) heated water device that can include a cold water tank and a hot water tank. The cold water tank can be configured to be in fluid communication with a cold water source and can be configured to store cold water. The hot water tank can be configured to (i) be in selective fluid communication with the hot water source, (ii) be in selectively fluid communication with the cold water source, and (iii) store hot water. There can be a water temperature differential between the hot water of the hot water tank and the cold water of the cold water tank. The POU heated water device can include a pump configured to selectively pump the hot water to the hot water tank from the hot water source and can include a valve configured to selectively permit water to flow from the hot water tank to the cold water source. The POU heated water device can include a thermoelectric generator (TEG) configured to convert the water temperature differential to electrical energy.

The cold water tank can have an outlet configured to discharge cold water to a POU plumbing fixture.

The POU heated water device can include a battery in electrical communication with the TEG, and the battery can be configured to store the electrical energy generated by the TEG.

The POU heated water device can include a plurality of fins located proximate a top surface of the cold water tank.

The POU heated water device can include insulating material disposed about at least a portion of the hot water tank.

The POU heated water device can include a hot water attachment point that is configured to receive water from the hot water source, a cold water source attachment point that is configured to fluidly communicate with the cold water source, and a POU cold water attachment point that is configured to expel water toward the point of use.

The POU heated water device can include a controller configured to output instructions for operation of the pump and/or the valve.

The controller can be configured to, in response to determining that hot water should be put into the hot water tank of the POU heated water device, output instructions for the valve to open and/or for the pump to pump water from the hot water line and to the hot water tank.

The controller can be configured to, in response to determining that a sufficient amount of hot water is in the hot water tank, output instructions for the valve to close and for the pump to deactivate.

The controller can be configured to, in response to determining that water should be purged from a hot water line of the POU plumbing fixture, output instructions for the valve to open and/or for the pump to pump water from the hot water line and to the hot water tank.

The controller can be configured to, in response to determining that a sufficient amount of water has been purged from the hot water line of the POU plumbing fixture, output instructions for the valve to close and/or for the pump to deactivate.

Determining that water should be purged from the hot water line of the POU plumbing fixture can include receiving temperature data from a temperature sensor—the temperature data being indicative of a water temperature at a location of the temperature sensor—and determining that the water temperature is less than a temperature threshold.

The temperature sensor can be located at, in, or near the hot water line of the POU plumbing fixture.

The temperature sensor can be located at, in, or near the hot water tank.

Determining that water should be purged from the hot water line of the POU plumbing fixture can include receiving sensor data from a sensor of the POU heated water device—the sensor data being indicative of a detected presence of a person at a location near the POU plumbing fixture—and determining, based on the sensor data, that a person is within a predetermined distance from the POU plumbing fixture.

Determining that water should be purged from the hot water line of the POU plumbing fixture can include receiving energy data from a battery of the POU heated water device—the battery being configured to store the electrical energy generated by the TEG and the energy data being indicative of an amount of currently stored energy—and determining that the amount of currently stored energy is less than a first stored energy threshold.

Determining that hot water should be put into the hot water tank of the POU heated water device can include determining that the current amount of stored energy is less than a stored energy threshold.

The controller can be configured to receive updated energy data from the battery, and the updated energy data can be indicative of an updated amount of currently stored energy.

The disclosed technology includes a method for providing a substantially immediately available supply of hot water at a POU plumbing fixture. The method can include storing cold water in a cold water tank of a POU heated water device, and the cold water can be received from a cold water supply line associated with the POU plumbing fixture. The method can include purging cooled water from a hot water supply line associated with the POU plumbing fixture. Purging the cooled water from the hot water supply line can include opening a valve located between a hot water tank of the POU heated water device and the cold water supply line; pumping the cooled water out of the hot water supply line, through the hot water tank, and to the cold water supply line; closing the valve; and pumping heated water from the hot water supply and into the hot water tank. The method can include activating a TEG of the POU heated water device, and the TEG can be configured to convert a water temperature differential to electrical energy. The water temperature differential can be defined by the heated water in the hot water tank and the cold water in the cold water tank. The method can include storing the electrical energy in a battery.

The method can include powering the pump with electrical energy stored by the battery.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, are incorporated into, and constitute a portion of, this disclosure, illustrate various implementations and aspects of the disclosed technology and, together with the description, serve to explain the principles of the disclosed technology. In the drawings.

DETAILED DESCRIPTION

Figure 1:
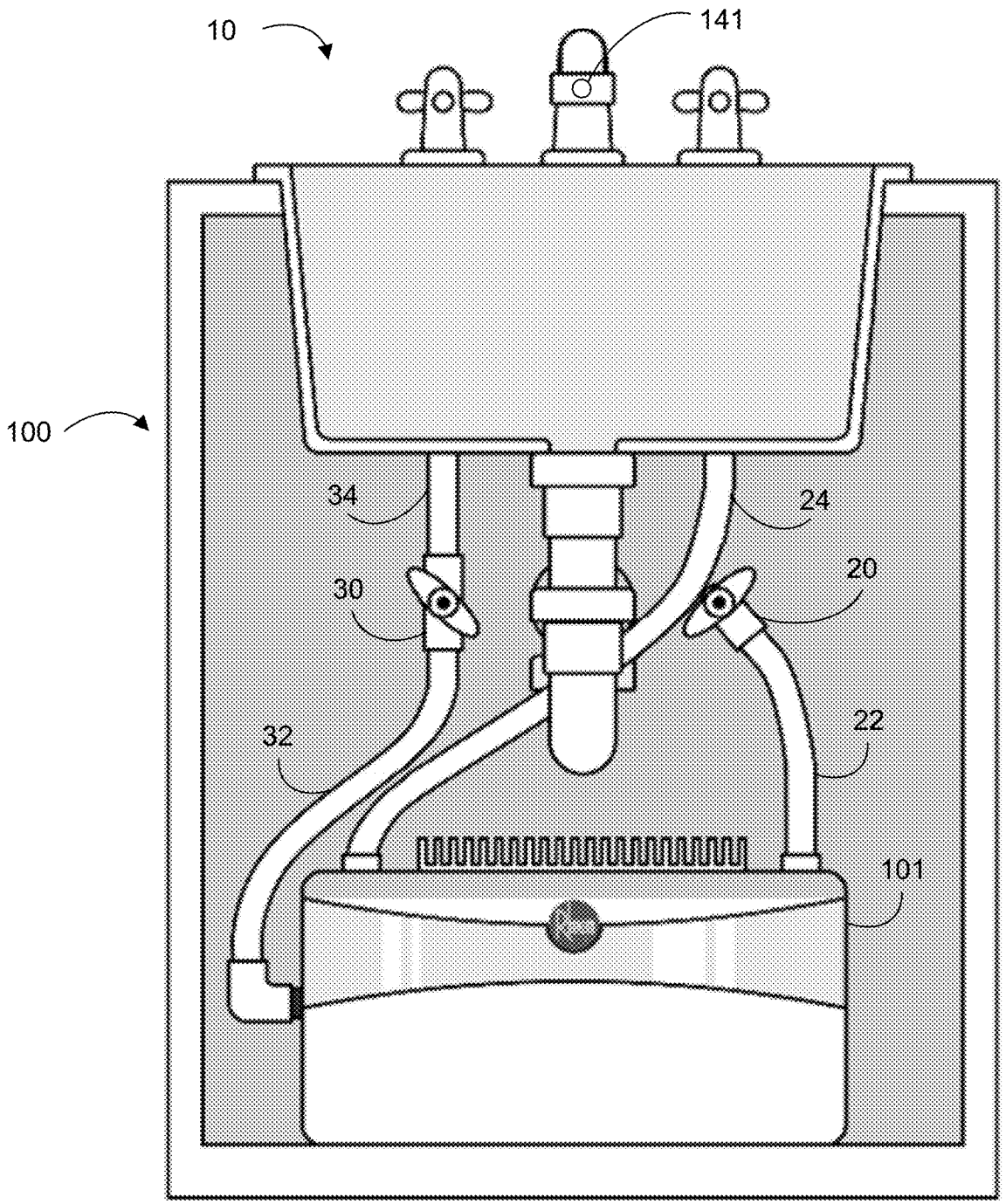
FIG. 1 illustrates a schematic view of an example point-of-use (POU) heated water system, in accordance with the disclosed technology.

The disclosed technology relates generally to point-of-use (POU) heated water systems and methods for providing a substantially immediately available supply of hot water at a POU plumbing fixture. As described more fully herein, the disclosed systems and methods make possible an immediately (or substantially immediately) available supply of heated water at a point of use without requiring an external power source. Further, the disclosed systems and methods do not require a user to replace or recharge a battery of the system. Further still, the disclosed technology can be installed at an existing point of use with only minor plumbing retrofitting required; that is, the disclosed technology can be installed at an existing point of use without any modification to an electrical infrastructure.

Some examples of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

As used herein, the phrases "heated water" or "hot water" refers to water that has been heated by a water heater (e.g., a central water heater of a building in which the point-of-use (POU) heated water device and corresponding POU plumbing fixture (e.g., shower, sink) are located). The phrase "cooled water" refers to water that was heated by a water heater but has subsequently cooled such it has a temperature that is less than a target temperature That is, "cooled water" is water that has been heated but is no longer sufficiently heated. The phrase "cold water" refers to water that has not been heated (e.g., water from cold water plumbing lines).

Further, as used herein, the phrases "immediately available heated water," "immediately available hot water," "substantially immediately available heated water," "substantially immediately available hot water," and the like refer to a scenario in which the water stored in hot water lines at a POU plumbing fixture are at or near a target heated water temperature (e.g., the temperature set point of a central water heater, within a predetermined range of the temperature set point of the central water heater, within a predetermined target POU heated water temperature range). For example, heated water can be considered immediately available or substantially immediately available if sufficiently heated water can be released upon demand of heated water at the POU plumbing fixture (e.g., a user turning a hot water handle at a sink).

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to example embodiments of the disclosed technology, examples of which are illustrated in the accompanying drawings and disclosed herein. Wherever convenient, the same reference numbers will be used throughout the drawings to refer to the same or like parts.

Referring to FIG. 1, an example point-of-use (POU) heated water system 100 (or heated water supply system) is illustrated as installed at a sink 10. The POU heated water system 100 can include a POU heated water device 101 that can be fluidly connected to a cold water supply 20 and a hot water supply 30. Specifically, the heated water device 101 can be connected to the cold water supply 20 via a cold water supply line 22 and can be connected to the hot water supply 30 via a hot water supply line 32. The hot water supply line 32 can extend between the hot water supply 30 and the heated water device 101, and a POU hot water supply line 34 can extend between the hot water supply 30 and the point of use, here depicted as the sink 10. Water can be transported from the hot water supply 30 and either to the heated water device 101 via the POU hot water supply line 34 or to the sink 10 (or any other point of use) via the hot water supply line 32. That is to say, cooled water can be purged from the hot water supply 30 and flowed through the POU heated water device 101 such that hot water can be ready to provide from the hot water supply 30 and to the sink 10. Cold water can be transported to the sink 10 (or any other point of use) via sequential flow through the cold water supply line 22, the heated water device 101, and a POU cold water supply line 24.

Figure 2:
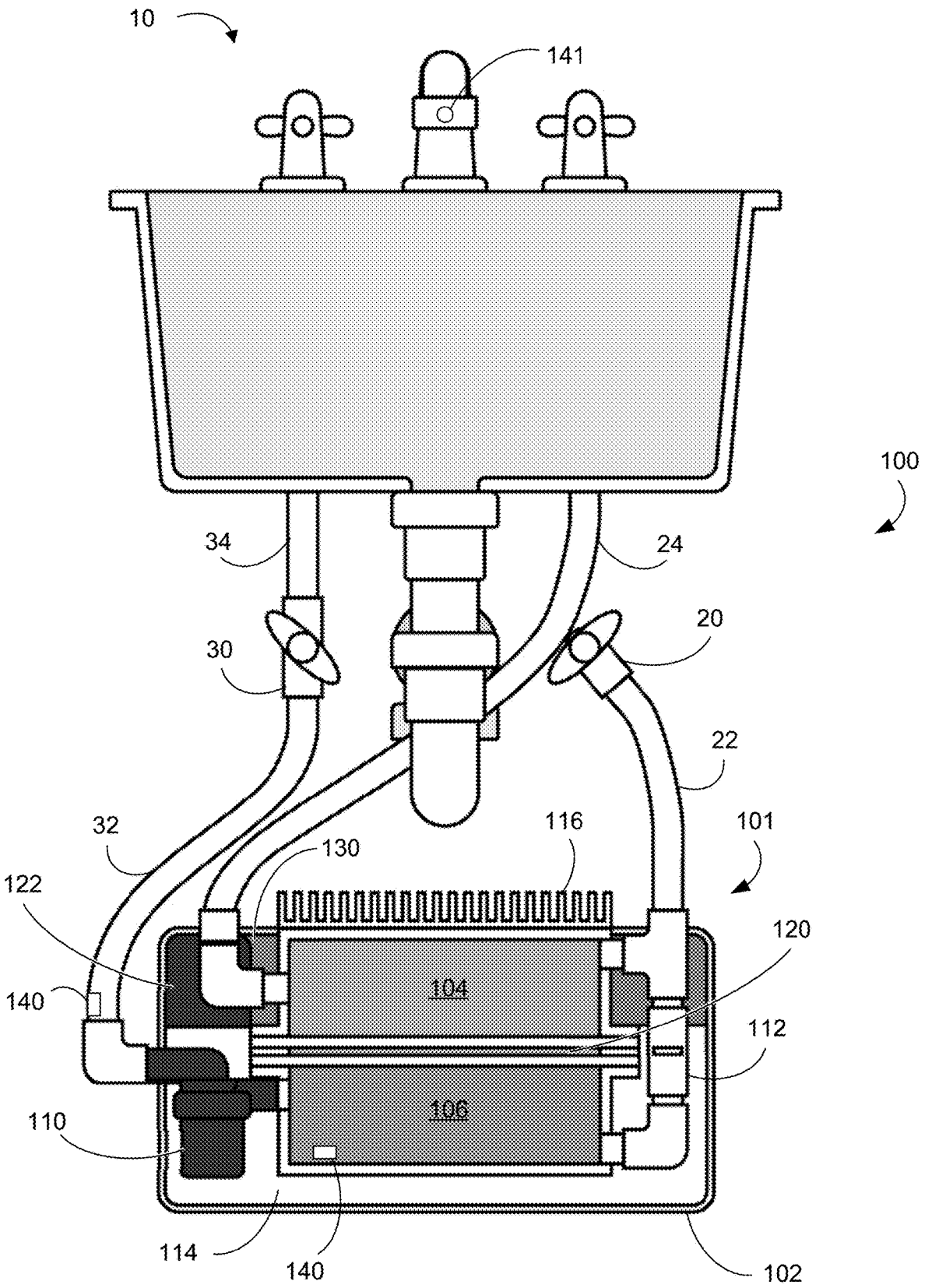
FIG. 2 illustrates a schematic view of an example POU heated water system with the front cover removed, in accordance with the disclosed technology.

The heated water device 101 can include a housing 102, a cold water tank 104, and a hot water tank 106, as shown in FIG. 2, for example. The heated water device 101 can be sized and dimensioned to fit underneath a sink 10 or at another point of use. For example, the overall dimensions of the heated water device 101 can be less than or equal to approximately 22 inches wide, less than or equal to approximately 15 inches deep, and/or less than or equal to approximately 9.5 inches tall. The cold water tank 104 and the hot water tank 106 can have the same dimensions and/or can be configured to hold the same volume of liquid. The cold water tank 104 can be in fluid communication with the cold water supply line 22 and the POU cold water supply line 24, and the hot water tank 106 can be in fluid communication with the hot water supply line 32 and the cold water tank 104. The hot water tank 106 can also be in fluid communication with the cold water supply line 22. The heated water device 101 can include a pump 110 configured to pump water. As will be described more fully herein, the pump 110 can be configured to pump water into the hot water tank 106. The heated water device 101 can include one or more valves 112 configured to permit or prevent the flow of water. As illustrated, the heated water device 101 can include a valve 112 located between the hot water tank 106 and the cold water supply 20. The heated water device 101 can include one or more other valves, however. For example, the heated water device 101 can optionally include a valve located between the cold water tank and the cold water supply line 22. The valve(s) (e.g., valve 112) can be any type of valve, such as, for example, a stepper motor valve, a solenoid valve, a ball valve, a butterfly valve, a gate valve, or the like. Optionally, the heated water device 101 can include insulation 114 to help reduce heat loss from the hot water tank 106 and/or other portions or components of the heated water device 101. The insulation can include polystyrene, polyurethane, and/or any other insulative material. Alternatively or additionally, the heating device can include fins 116, as described more fully herein.

The heated water device 101 can include a thermoelectric generator (TEG) 120 and a battery 122. As will be appreciated, the cold water tank 104 can hold an amount of cold, unheated water, and the hot water tank 106 can hold an amount of heated water. Thus, there can be a temperature differential between the cold water tank 104 and the hot water tank 106. The TEG 120 can be configured to generate power by converting heat flow from this temperature differential into electrical energy (e.g., through a phenomenon called the Seebeck effect). The produced electrical energy can be used to power the pump 110 and/or the valve 112 (and/or other valves). Alternatively or additionally, the produced electrical energy can be stored in the battery 122. To effect this production of electrical energy, the TEG 120 must be in thermal communication with both the cold water tank 104 and the hot water tank 106. To facilitate this thermal communication, the TEG 120 can be located between the cold water tank 104 and the hot water tank 106. The TEG 120 can include any useful thermoelectric material or combination of thermoelectric materials. For example, the TEG 120 can include one or more alloys based on bismuth in combination with antimony, tellurium, or selenium. Other thermoelectric materials can be used.

The cold water tank 104 and/or the hot water tank 106 can be made from a variety of materials, such as copper, for example. The cold water tank 104 and/or the hot water tank 106 can be made from a single material, or alternatively, the cold water tank 104 and/or the hot water tank 106 can be made from multiple different materials. The hot water tank 106, in particular, can be made from multiple different materials having different heat transfer characteristics, which can help prevent undesired heat loss and/or heat transfer from hot water inside the hot water tank 106 (i.e., portions of the hot water tank 106 other than the face or portion abutting or adjacent to the TEG 120). For example, the hot water tank 106 can include a thermally insulating material (e.g., a plastic, such as polyurethane, polystyrene, or the like) for some or each face or portion other than the face or portion abutting or adjacent to the TEG 120. The face or portion of the hot water tank 106 that abuts or is adjacent to the TEG 120 can include copper or another material having a high thermal conductivity. Thus, the hot water tank 106 can be configured to prevent the escape of heat from the hot water therein via any portion of the hot water tank 106 other than the face or portion of the hot water tank 106 that abuts or is adjacent to the TEG 120.

The heated water device 101 can include a controller 130 or any other processing circuitry. The controller 130 can be in electrical communication with the TEG 120, the battery 122, the pump 110, and/or the valve 112 (or an actuating device configured to open/close the valve 112). The controller 130 can include memory and one or more processors. The memory can store instructions that, when executed by the processor(s), cause the controller 130 to perform one, some, or all of the methods described herein. For example, the controller 130 can output instructions for the pump 110 to pump water from the hot water supply 30 to the hot water tank 106 to the point of use (e.g., to purge cooled water from the hot water supply 30, to introduce hot water into the hot water tank 106). As another example, the controller 130 can output instructions for the valve 112 to open or close (e.g., to permit cooled water to flow from the hot water supply 30, through the hot water tank 106, and to the cold water supply 20 and/or cold water tank 104). Optionally, the controller 130 can be in electrical communications with a transceiver configured to communicate with one or more computing devices directly or via a network. For example the heated water device 101 can be configured to communicate with a user's mobile device (e.g., via a website, via a dedicated application on the user's mobile device). The controller 130 can be configured to output use data indicative of the operation of the heated water device 101, such as the temperature of water currently in the hot water tank 106, the temperature of water currently available at or near the hot water supply 30 (e.g., the temperature of water in the POU hot water supply line 34). The controller 130 can be configured to determine (e.g., based on a learning algorithm, such as by artificial intelligence, historical use data, and/or identified trends in historical use data), the frequency by which to purge water from the hot water supply 30 to ensure hot water (i.e., water having a temperature that is above a predetermined temperature threshold) is readily available at the hot water supply 30. That is to say, the controller 130 can be configured to receive use data and/or historical use data, analyze the data to determine trends hot water demands at the sink 10, cooling times (e.g., calculate average times for water at the hot water supply 30 to cool to a temperature that is less than a predetermined temperature threshold), and the like. Using this data, the controller 130 can be configured to output instructions for operation of one or more components of the heated water device 101.

The heated water device 101 can be configured to operate in different modes. For example, the heated water device 101 can operate in a pre-circulation mode, a circulation mode, a post-circulation mode, a battery charging mode, and a flush mode. Operation of the heated water device 101 in each of these modes is now described with respect to FIGS. 3A-3E.

Figure 3A:
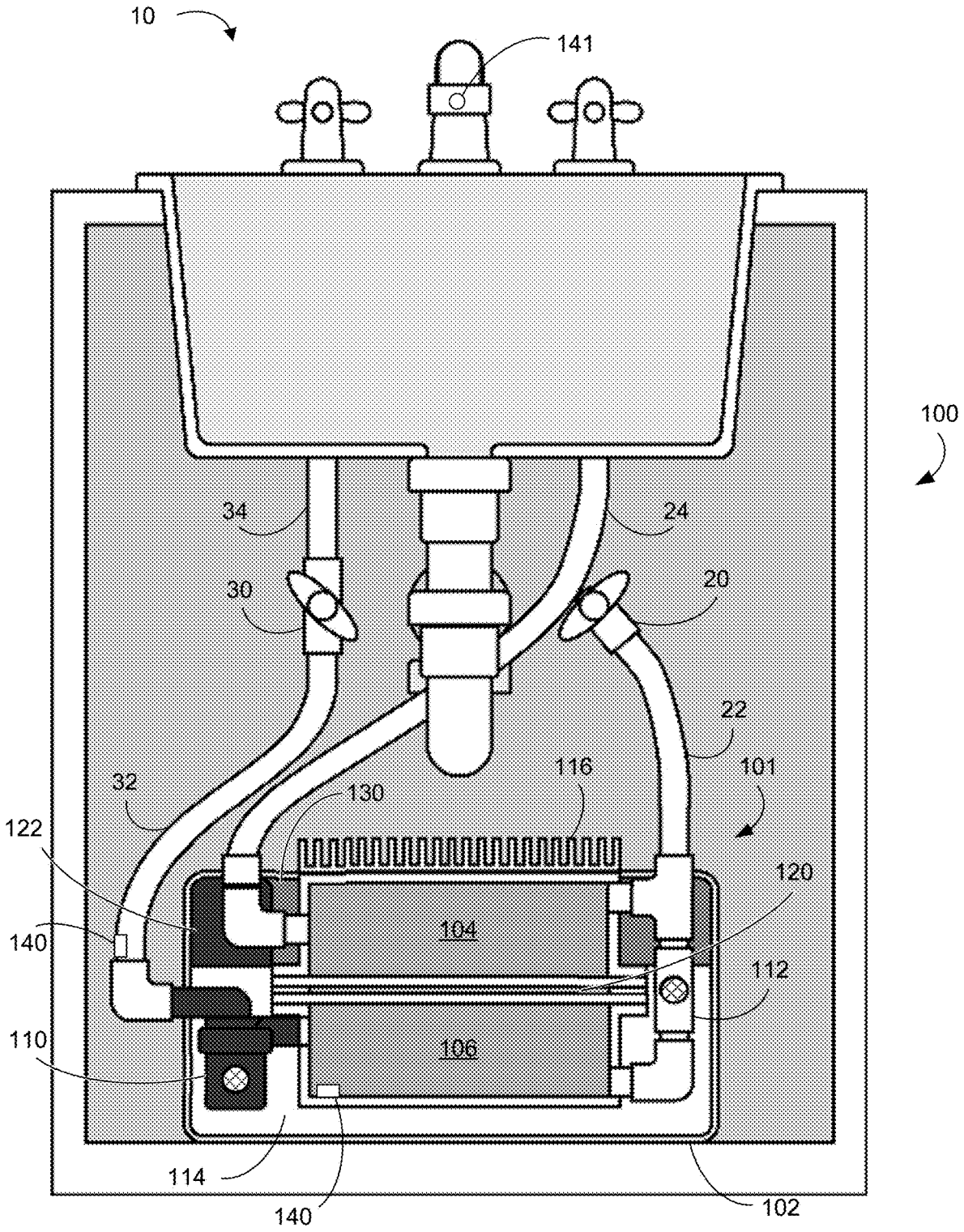
FIGS. 3A-3E illustrate a schematic view of an example POU heated water system in various stages of operation, in accordance with the disclosed technology.

Referring to FIG. 3A, pre-circulation mode (or standby mode) can correspond to a scenario in which hot water is not being demanded at the point of use (e.g., the sink 10). For example, the heated water device 101 can be in pre-circulation mode when the water in the hot water tank is cold, and the battery is fully charged. As indicated by the cross-hatched circles shown on the pump 110 and the valve 112 in FIG. 3A, while in pre-circulation mode, the pump 110 and the valve 112 can be closed or otherwise configured to prevent water from entering or exiting the hot water tank 106.

Figure 3B:
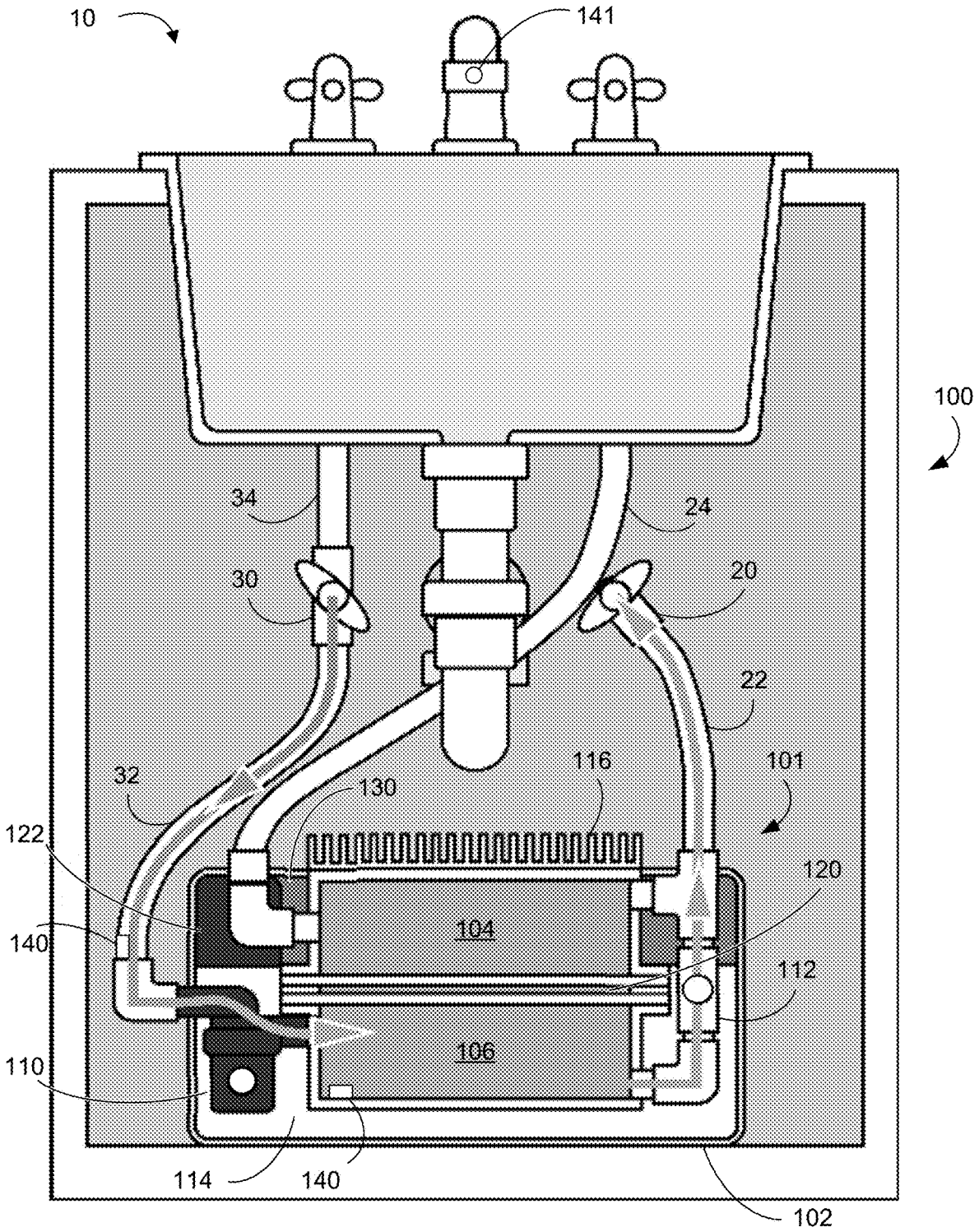

Referring to FIG. 3B, circulation mode can correspond to times prior to user demand. Optionally, the heated water device 101 can be configured to transition to circulation mode based on a schedule that is determined based on historical use data and/or identified trends in historical use data, which can include historical temperature data. The historical temperature data can correspond to water temperature detected by one or more temperature sensors 140 (e.g., one or more temperature sensors configured to detect a temperature of the hot water tank 106 and/or a temperature of water inside the hot water tank 106). For example, a temperature sensor 140 can be located at or in the POU hot water supply line 34, and/or a temperature sensor 140 can be located at or in the plumbing of the hot water supply 30. The temperature data from the temperature sensor(s) 140 at the POU hot water supply line 34 and/or the plumbing of the hot water supply 30, can be used to determine whether heated water is available for immediate use at the sink 10 or other point of use. That is, if the temperature of the water in the POU hot water supply line 34 and/or the plumbing of the hot water supply 30 is below a temperature threshold (e.g., a predetermined temperature threshold, the target hot water temperature), the controller 130 can determine that the heated water device 101 should operate in circulation mode to flush cooled water from the hot water lines.

Additionally or alternatively, as another example, the controller 130 can be configured to operate the heated water device 101 in circulation mode based at least in part on whether the temperature of water in the hot water tank 106 is less than a temperature threshold (e.g., a predetermined temperature threshold). As a more specific example, the controller 130 can be configured to operate the heated water device 101 in circulation mode if the temperature of water in the hot water tank 106 is less than a temperature threshold and the current time is within a specified time range (which the controller 130 can determine based on historical use data).

Alternatively or additionally, the POU heated water system 100 can include a sensor 141 (e.g., a proximity sensor, an occupancy sensor) that can detect the presence of a user at or near the point of use. As an illustrative example, the POU heat water system 100 can include a sensor 141 located within the faucet of the point of use. Alternatively or additionally, the sensor 141 can be located separate from the point of use (e.g., in a wall, cabinet, or the like). The controller 130 can be configured to operate the heated water device 101 in circulation mode when the energy level of the battery 122 falls below an energy threshold (e.g., a predetermined energy threshold).

In circulation mode, the controller 130 can output instructions for the valve 112 between the hot water tank 106 and the cold water tank to open (as indicated by the empty circle shown on the valve 112 in FIG. 3B), and the controller 130 can output instructions for the pump 110 to activate and pull heated water from the hot water supply 30 (as indicated by the empty circle shown on the pump 110 in FIG. 3B), thereby purging now-cooled water (e.g., water that currently has a temperature less than the target heated water temperature) from the hot water supply line 32 and/or the hot water tank 106. The pump 110 can push this now-cooled water from the hot water supply line 32 and/or from the hot water tank 106 to the cold water supply 20. The pump 110 can do this by providing a water pressure that is greater than the water pressure of the cold water supply 20. Thus, circulation mode can serve to circulate water through the hot water tank 106, flushing cooled water from the hot water tank 106 and replacing the purged cooled water with heated water.

Figure 3C:
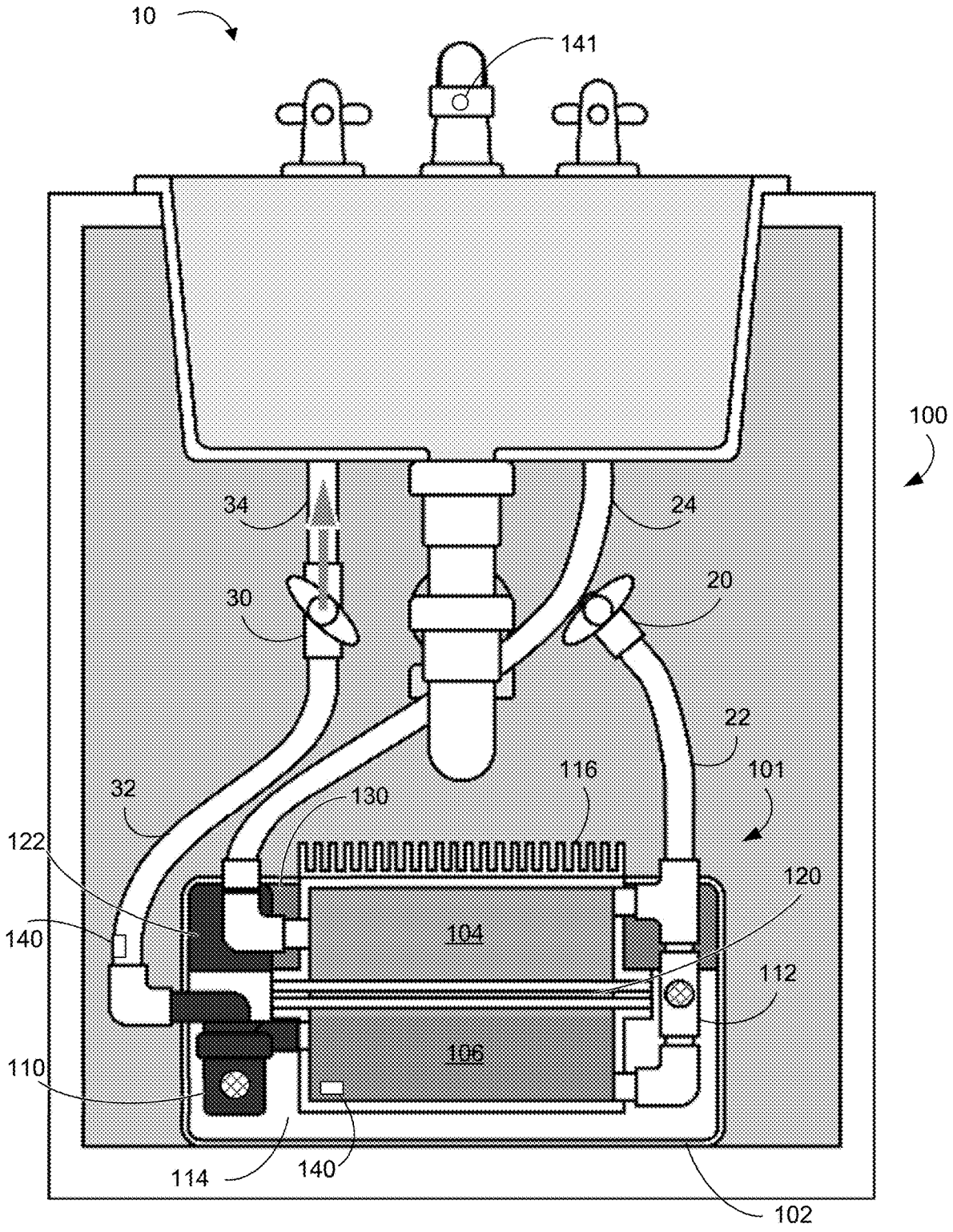

Once circulation mode has been completed, the heating device can be in post-circulation mode, as illustrated in FIG. 3C. In post-circulation mode, the pump 110 and the valve 112 can be closed or otherwise configured to prevent water from entering or exiting the hot water tank 106, as indicated by the cross-hatched circles shown on the pump 110 and the valve 112 in FIG. 3C. Thus, in post-circulation mode, now-cooled water (water that was previously heated but remained in pipes so long that the water is no longer "hot" or heated to the target heated temperature) is purged from the plumbing of the hot water supply 30 and/or the POU hot water supply line 34 such that hot water is immediately available for use at the sink 10 or other point of use. Further, heated water is stored in the hot water tank 106 for use by the TEG 120 for battery charging, if needed.

Figure 3D:
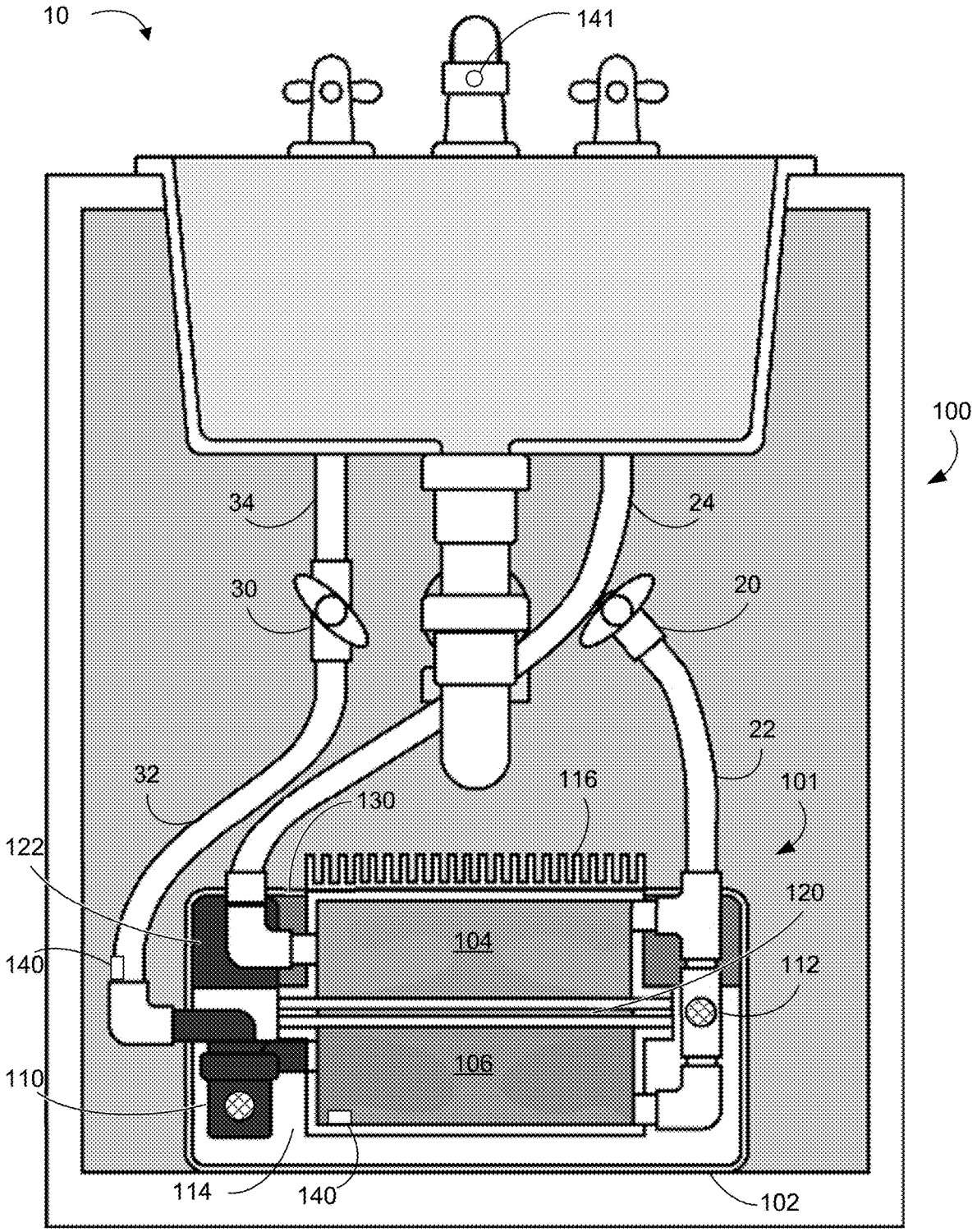

Referring now to FIG. 3D, when heated water is stored in the hot water tank 106, the heated water device can be in battery charging mode, and TEG 120 can generate electrical energy that can be stored in the battery 122. As indicated by the cross-hatched circles shown on the pump 110 and the valve 112 in FIG. 3D, while in battery charging mode, the pump 110 and the valve 112 can be closed or otherwise configured to prevent water from entering or exiting the hot water tank 106. As the TEG 120 generates electrical energy, heat will flow via the TEG 120 from the water in the hot water tank 106 to the water in the cold water tank 104. As the water in the cold water tank 104 absorbs heat, the gained heat can be dissipated away from the cold water tank 104 and into the surrounding environment via the fins 116 (e.g., a heatsink). This can increase and/or help prolong the temperature difference between the hot water tank 106 and the cold water tank 104, which can result in increased energy production by the TEG 120. That is, the changing density of water can induce natural convection within the cold water tank 104, which can expedite the heat transfer process and help maintain a stable temperature differential between the cold water tank 104 and the hot water tank 106. Optionally, the POU heated water system 100 can include a fan to move air across the fins 116 (e.g., to provide a fan-cooled heatsink). The inclusion of a fan can increase heat dissipation from the cold water tank 104, but operation of the fan can also increase overall energy consumption of the POU heated water system 100. Regardless, electrical energy generated by the TEG 120 can be stored in the battery 122.

Figure 3E:
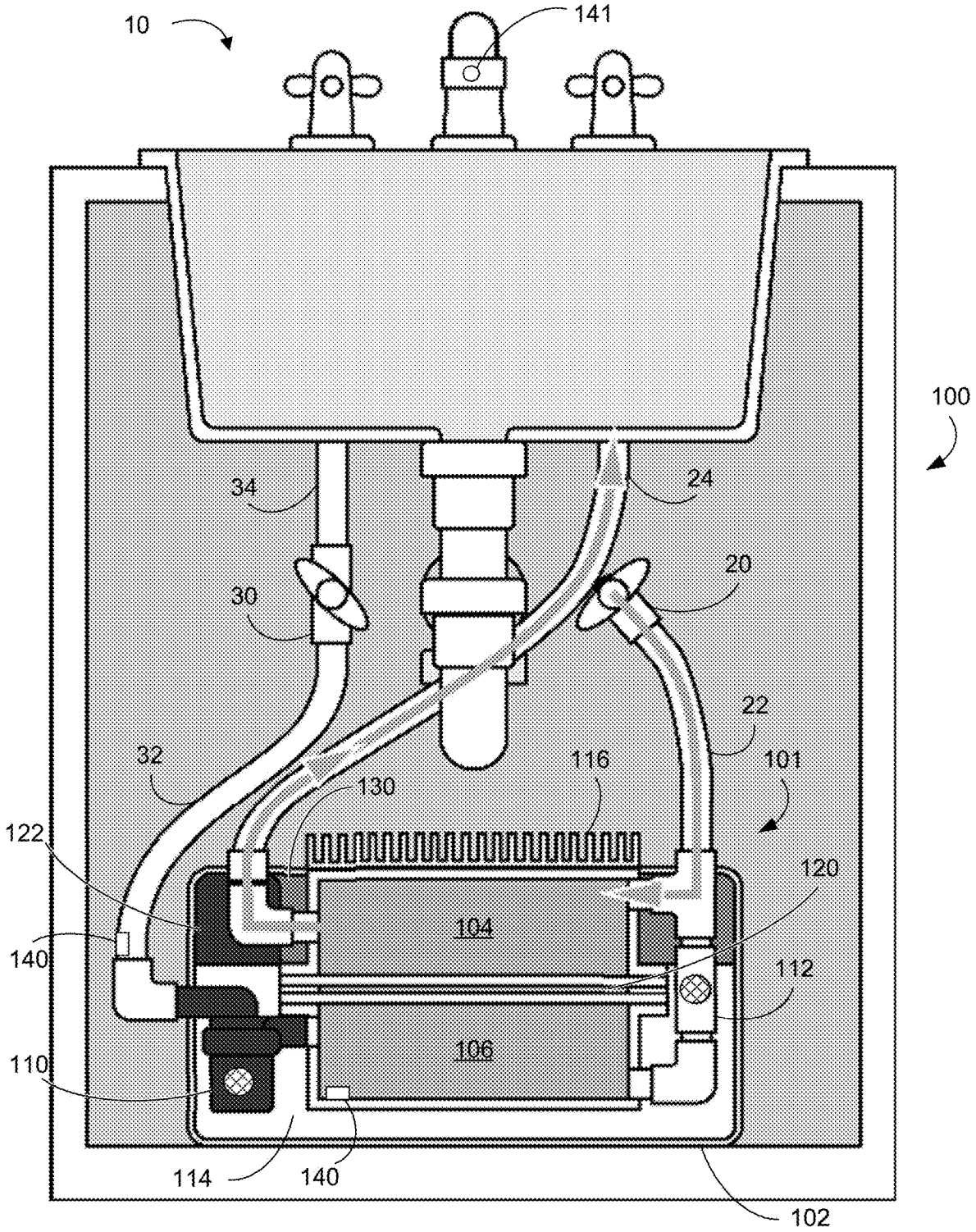

Referring to FIG. 3E, the heated water device 101 can operate in flush mode to discharge the water stored in the cold water tank 104 and replace it with new cold water from the cold water source 20. As indicated by the cross-hatched circles shown on the pump 110 and the valve 112 in FIG. 3E, while in flush mode, the pump 110 and the valve 112 can be closed or otherwise configured to prevent water from entering or exiting the hot water tank 106. If there is a demand for more cold water than the cold water tank 104 can hold, water can flow from the cold water source 20, through the cold water tank 104 and to the sink 10 or other point of use. Once the demand for cold water stops, the cold water tank 104 can be refilled with cold water from the cold water source 20.

Figure 4:
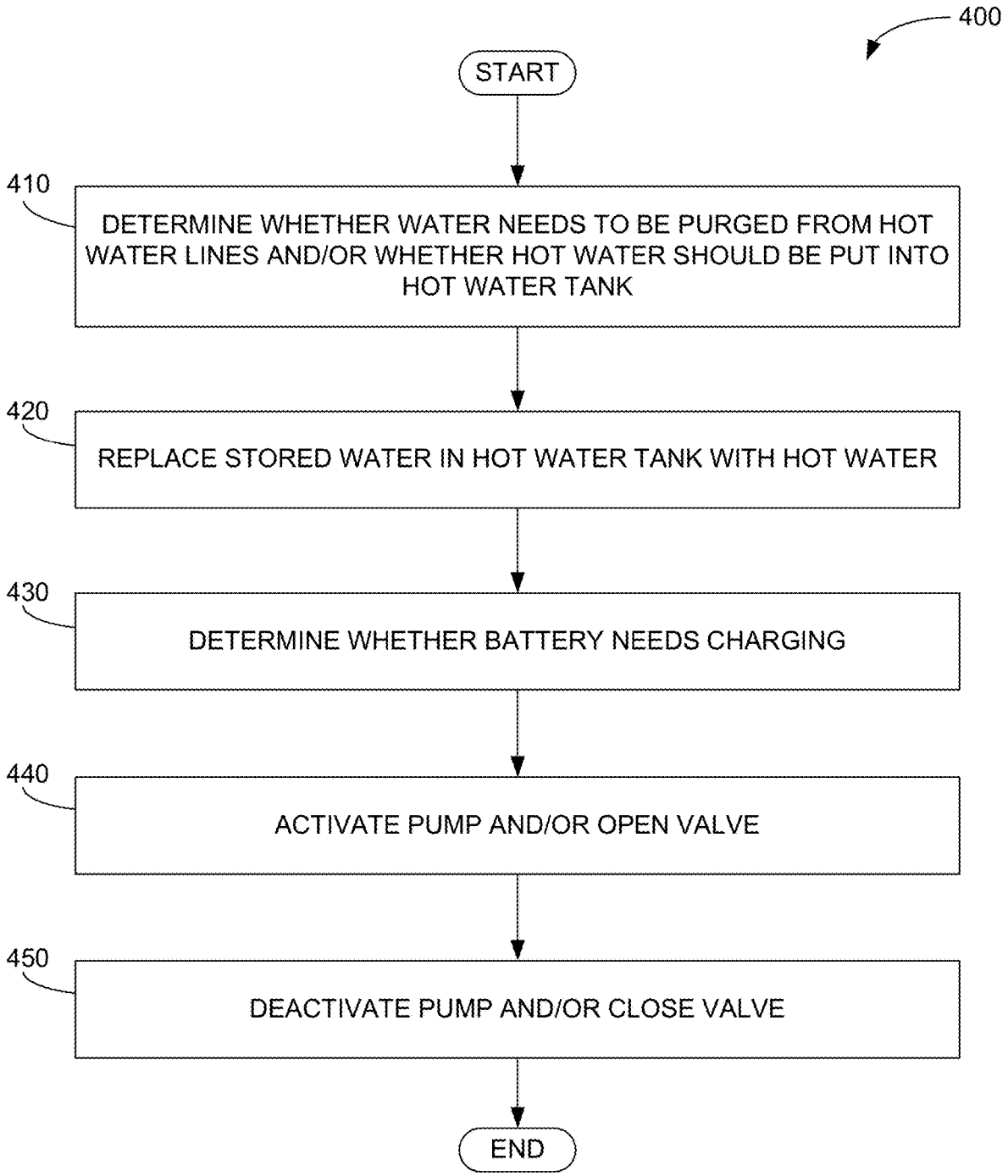
FIG. 4 illustrates a flowchart of an example method for controlling a POU heated water system, in accordance with the disclosed technology.

Referring now to FIG. 4, the disclosed technology includes a method 400 for controlling a POU heated water system (e.g., POU heated water system 100). That is to say, the method 400 can be performed in full or in part by a controller (e.g., control 130) or some other type of processing circuitry.

The method 400 can include determining 410 whether water should be purged from the hot water line(s) of the system (e.g., the POU hot water supply line 34 and/or the plumbing of the hot water supply 30), and/or the method 400 can include determining 410 whether hot water should be put into the hot water tank (e.g., hot water tank 106). To make this determination, the method 400 can include receiving temperature data from one or more temperature sensors. For example, the method 400 can include receiving temperature data from a temperature sensor located at, in, or near the hot water line(s) of the system. If the temperature data is indicative of a water temperature that is below a POU hot water temperature threshold, it can be determined that water needs to be purged from the hot water line(s). Alternatively or additionally, the method 400 can include receiving temperature data from a temperature sensor located at, in, or near the hot water tank. If the temperature data is indicative of a water temperature that is below a hot water tank temperature threshold, it can be determined that hot water should be put into the hot water tank.

Alternatively or additionally, it can be determined that water needs to be purged from the hot water line(s) and/or that hot water should be put into the hot water tank if the current time is within a particular range of time (e.g., a particular time of day and/or a particular day of the week).

Alternatively or additionally, the method 400 can include receiving an indication of the energy currently stored by a battery of the system (e.g., battery 122) and determining whether the current amount of stored energy is less than a predetermined energy threshold. As described herein, the hot water stored in the tank can be used, along with cold water stored in a cold water tank (e.g., cold water tank 104), by a thermoelectric generator (TEG) (e.g., TEG 120) to generate electrical energy. Thus, if the current amount of stored energy is less than the predetermined energy threshold, it can be determined that hot water should be put into the hot water tank.

Alternatively or additionally, the method 400 can include receiving, from a sensor (e.g., a proximity sensor, an occupancy sensor), sensor data to determine whether a user is at or near the point of use (e.g., sink 10). For example, the sensor can transmit sensor data to the controller 130, and the controller 130 can determine whether a person (or object) has come within a predetermined distance from the point of use. To help minimize false positives, the controller 130 can determine whether a person has come within the predetermined distance for a predetermined amount of time (e.g., to prevent false detection of a passer-by who does not intend to demand water at the point of use). Based at least in part on the received sensor data, the controller 130 can determine that water needs to be purged from the hot water line(s). As an illustrative example, the method 400 can include determining that water needs to be purged from the hot water line(s) in response to receiving a signal from the sensor and determining that the temperature of water in the hot water line(s) is below the POU hot water temperature threshold.

The method 400 can include replacing 420 the water stored in the hot water tank with hot water from the hot water source (e.g., hot water source 30). That is, the method 400 can include, in response to determining water needs to be purged from the hot water line(s) and/or determining that hot water should be put into the hot water tank, pumping hot water from the hot water source into the hot water tank, thereby flushing stored water out of the hot water tank. The previously stored water can be flushed out of the hot water tank and into the cold water supply (e.g., cold water supply 20). To achieve this, the method 400 can include outputting instructions for activating and operating a pump (e.g., pump 110), and the method 400 can include outputting instructions for opening a valve (e.g., valve 112) located between the cold water supply and the hot water tank. Subsequently, the method 400 can include outputting instructions for deactivating the pump and for closing the valve (e.g., after a predetermined time, after a predetermined amount of hot water has flowed into the hot water tank, after a temperature of water in the hot water tank is greater than or equal to the hot water tank temperature threshold). For example, the instructions for deactivating the pump and for closing the valve can be outputted in response to determining that a sufficient amount of water has been purged from the hot water line(s) and/or in response to determining that a sufficient amount of hot water is now in the hot water tank.

The method 400 can include determining 430 whether the battery needs charging. For example, as described above, the method 400 can include receiving an indication of the energy currently stored by a battery of the system (e.g., battery 122) and determining whether the current amount of stored energy is less than a first predetermined energy threshold. If the current amount of stored energy is less than the first predetermined energy threshold, it can be determined that the battery needs charging. The method 400 can include outputting 440 instructions for activating and operating the pump and/or outputting instructions for opening the valve located between the cold water supply and the hot water tank such that cooled water can be purged from the hot water tank and replaced with heated water. Subsequently, the method 400 can include outputting 450 instructions for deactivating the pump and/or for closing the valve (e.g., after a predetermined time, after a predetermined amount of hot water has flowed into the hot water tank, after a temperature of water in the hot water tank is greater than or equal to the hot water tank temperature threshold). Once sufficiently hot water is located within the hot water tank, the TEG can generate electrical energy to charge the battery.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "one example," "an example," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A point-of-use (POU) heated water device comprising:

a cold water tank in fluid communication with a cold water source, the cold water tank configured to store cold water;

a hot water tank having (i) an inlet in selective fluid communication with a hot water line that is in fluid communication with a hot water source and (ii) an outlet in selective fluid communication with the cold water source, the hot water tank configured to selectively store hot water such that there is a water temperature differential between the hot water of the hot water tank and the cold water of the cold water tank;

a pump configured to selectively pump the hot water to the hot water tank from the hot water source;

a valve configured to selectively permit water to flow from the hot water tank to the cold water source; and a thermoelectric generator (TEG) configured to convert the water temperature differential to electrical energy, wherein the pump and valve are configured to periodically operate to purge cooled water from the hot water line to the cold water source via the hot water tank.

2. The POU heated water device of claim 1, wherein the cold water tank has an outlet configured to discharge cold water to a POU plumbing fixture.

3. The POU heated water device of claim 1 further comprising a battery in electrical communication with the TEG, the battery configured to store the electrical energy generated by the TEG.

4. The POU heated water device of claim 1 further comprising a plurality of fins disposed proximate a top surface of the cold water tank.

5. The POU heated water device of claim 1 further comprising insulating material disposed about at least a portion of the hot water tank.

6. The POU heated water device of claim 1 further comprising:

a hot water attachment point configured to receive water from the hot water source;

a cold water source attachment point configured to fluidly communicate with the cold water source; and a POU cold water attachment point configured to expel water toward a POU plumbing fixture.

7. The POU heated water device of claim 1 further comprising a controller configured to output instructions for operation of the pump and/or the valve.

8. The POU heated water device of claim 7, wherein the controller is configured to:

in response to determining that (i) water should be purged from a hot water line of a POU plumbing fixture or (ii) hot water should be put into the hot water tank of the POU heated water device, output instructions for:
the valve to open; and
the pump to pump water from the hot water line and to the hot water tank.

9. The POU heated water device of claim 8, wherein the controller is further configured to:
in response to determining that a sufficient amount of water has been purged from the hot water line of the POU plumbing fixture, output instructions for:
the valve to close; and
the pump to deactivate.

10. The POU heated water device of claim 8, wherein the controller is further configured to:
in response to determining that a sufficient amount of hot water is in the hot water tank, output instructions for:
the valve to close; and
the pump to deactivate.

11. The POU heated water device of claim 8, wherein determining that water should be purged from the hot water line of the POU plumbing fixture comprises:
receiving temperature data from a temperature sensor, the temperature data being indicative of a water temperature at a location of the temperature sensor; and
determining that the water temperature is less than a temperature threshold.

12. The POU heated water device of claim 11, wherein the temperature sensor is located at or in the hot water line of a POU plumbing fixture.

13. The POU heated water device of claim 11, wherein the temperature sensor is located at or in the hot water tank.

14. The POU heated water device of claim 8, wherein determining that water should be purged from the hot water line of the POU plumbing fixture comprises:
receiving sensor data from a sensor of the POU heated water device, the sensor data being indicative of a detected presence of a person at a location near the POU plumbing fixture; and
determining, based on the sensor data, that a person is within a predetermined distance from the POU plumbing fixture.

15. The POU heated water device of claim 8, wherein determining that water should be purged from the hot water line of the POU plumbing fixture comprises:
receiving energy data from a battery of the POU heated water device, the battery being configured to store the electrical energy generated by the TEG and the energy data being indicative of an amount of currently stored energy; and
determining that the amount of currently stored energy is less than a stored energy threshold.

16. The POU heated water device of claim 15, wherein determining that hot water should be put into the hot water tank of the POU heated water device comprises determining that the current amount of stored energy is less than the stored energy threshold.

17. A method for providing a substantially immediately available supply of hot water at a point-of-use (POU) plumbing fixture, the method comprising:
storing cold water in a cold water tank of a POU heated water device, the cold water being received from a cold water supply line associated with the POU plumbing fixture;
purging cooled water from a hot water supply line associated with the POU plumbing fixture by:
opening a valve located between a hot water tank of the POU heated water device and the cold water supply line;
pumping, with a pump of the POU heated water device, the cooled water out of the hot water supply line, through the hot water tank, and to the cold water supply line;
closing the valve; and
pumping, with the pump of the POU heated water device, heated water from the hot water supply line and into the hot water tank;
activating a thermoelectric generator (TEG) of the POU heated water device, the TEG being configured to convert a water temperature differential to electrical energy, the water temperature differential being defined by the heated water in the hot water tank and the cold water in the cold water tank; and
storing the electrical energy in a battery.

18. The method of claim 17 further comprising:
powering the pump with electrical energy stored by the battery.

19. The POU heated water device of claim 1, wherein the hot water tank is located below the cold water tank.

* * * * *